US006431361B1

(12) United States Patent
Wolf

(10) Patent No.: US 6,431,361 B1
(45) Date of Patent: Aug. 13, 2002

(54) CONTAINER PANELING FOR FORMING PNEUMATICALLY PADDED BOXES AND PADDED BOX CONSTRUCTION

(75) Inventor: Alon Wolf, Oakland, CA (US)

(73) Assignee: Aeropak, LLC, West Palm Beach, FL (US)

( * ) Notice: Subject to any disclaimer, the term of this patent is extended or adjusted under 35 U.S.C. 154(b) by 0 days.

(21) Appl. No.: 09/648,431

(22) Filed: Aug. 25, 2000

(51) Int. Cl.[7] ..... B65D 81/02
(52) U.S. Cl. ..... 206/522; 206/592
(58) Field of Search ..... 206/522, 591, 206/592, 594, 521; 383/3; 229/87.02

(56) References Cited

U.S. PATENT DOCUMENTS

| | | | | |
|---|---|---|---|---|
| 1,457,496 A | | 6/1923 | Butler | |
| 1,798,779 A | * | 3/1931 | Bowersock | 206/591 |
| 2,907,580 A | | 10/1959 | Tietig | |
| 3,072,270 A | | 1/1963 | Tolby et al. | |
| 3,346,101 A | | 10/1967 | Pestka | |
| 3,818,962 A | | 6/1974 | Muller-Scherak | |
| 3,889,743 A | | 6/1975 | Presnick | |
| 3,949,879 A | | 4/1976 | Peterson et al. | |
| 4,116,344 A | | 9/1978 | Ziemba | |
| 4,465,188 A | | 8/1984 | Soroka et al. | |
| 4,468,810 A | | 8/1984 | Longo | |
| 4,489,833 A | | 12/1984 | Bauer | |
| 4,551,379 A | | 11/1985 | Kerr | |
| 4,569,082 A | | 2/1986 | Ainsworth et al. | |
| 4,573,202 A | | 2/1986 | Lee | |
| 4,872,558 A | | 10/1989 | Pharo | |
| 4,874,093 A | | 10/1989 | Pharo | |
| 4,905,835 A | | 3/1990 | Pivert et al. | |
| 4,918,904 A | | 4/1990 | Pharo | |
| 4,949,530 A | | 8/1990 | Pharo | |
| 4,997,087 A | | 3/1991 | Lorenz | |
| 5,042,663 A | | 8/1991 | Heinrich | |
| 5,180,060 A | | 1/1993 | Forti et al. | |
| 5,272,856 A | | 12/1993 | Pharo | |
| 5,445,274 A | | 8/1995 | Pharo | |
| 5,564,570 A | | 10/1996 | Jaszai | |
| 5,588,533 A | | 12/1996 | Farison et al. | |
| 5,624,035 A | * | 4/1997 | Kim | 206/522 |
| 5,769,232 A | * | 6/1998 | Cash et al. | 206/522 |

* cited by examiner

*Primary Examiner*—Luan K. Bui
(74) *Attorney, Agent, or Firm*—Harris Zimmerman, Esq.

(57) ABSTRACT

A flat sheet of box material has fold lines demarcated thereon for forming the sheet into a rectangular box for containing and protecting articles. Inflatable air pouches are secured to portions of the sheet which become the inner walls of the top, bottom and sides of the box. Air passages communicate the pouches with each other and an air vale enables simultaneous inflation of the pouches after the box has been filled and closed. Assembly of boxes at factories or elsewhere is facilitated as it is not necessary to insert liners or add other cushioning material at that time.

6 Claims, 5 Drawing Sheets

FIG. 2
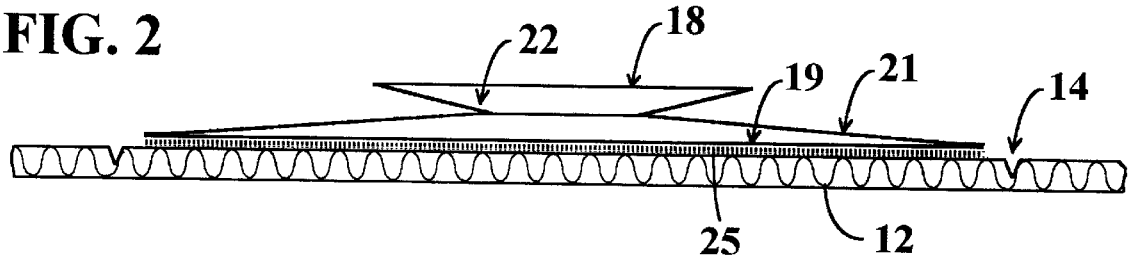
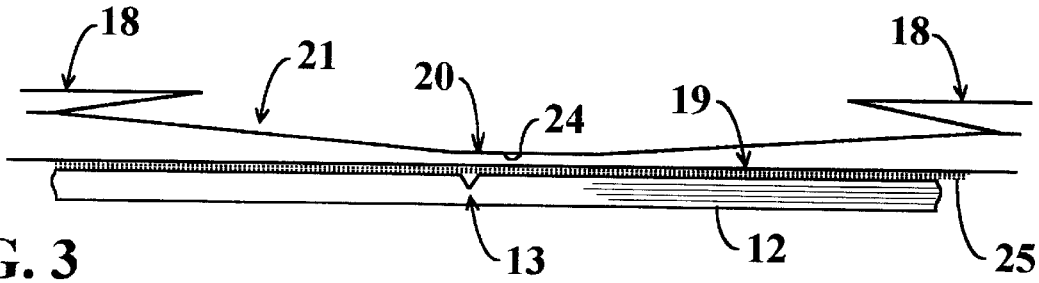
FIG. 3
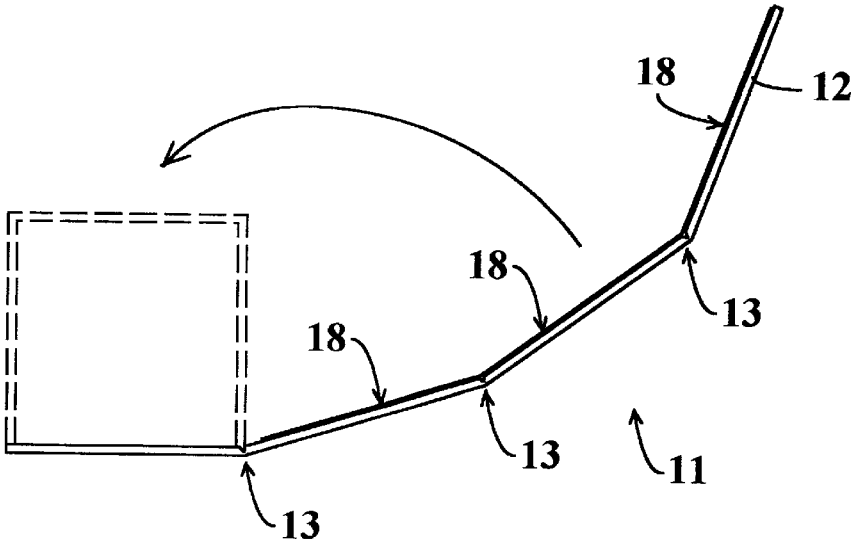
FIG. 4

FIG. 10
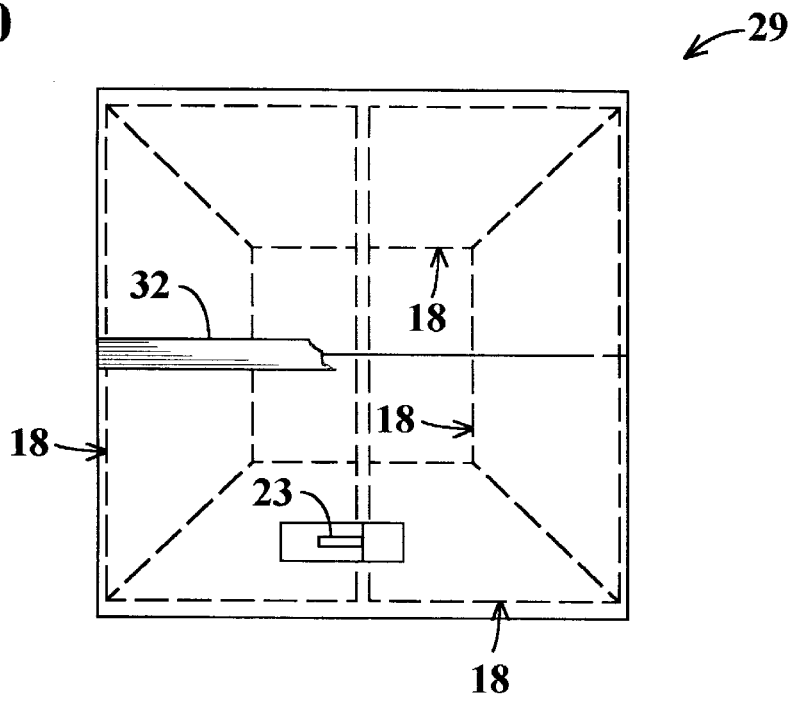
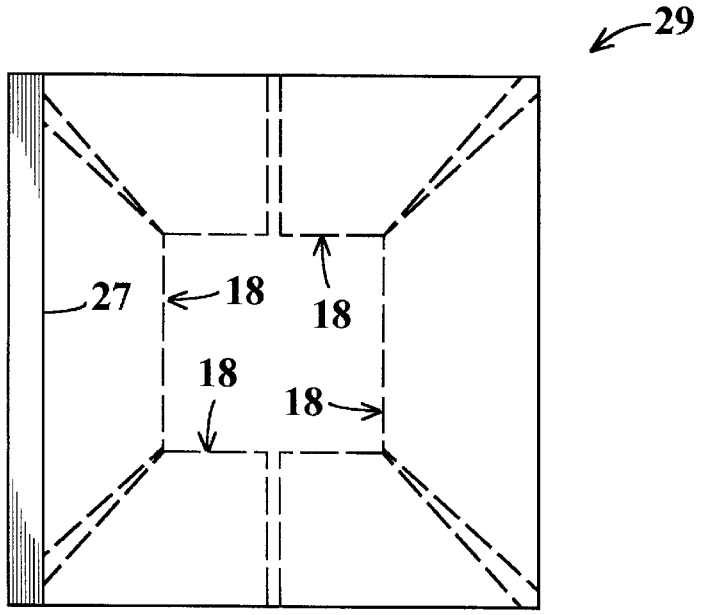
FIG. 9

CONTAINER PANELING FOR FORMING PNEUMATICALLY PADDED BOXES AND PADDED BOX CONSTRUCTION

TECHNICAL FIELD

This invention relates to the packaging of articles for shipping or storage and more particularly to the construction of boxes wherein contained articles are cushioned for protection against external forces that may be exerted against the box.

BACKGROUND OF THE INVENTION

Articles which are packaged in a box for shipping or storage are often protected by a shock absorbent material which isolates the article from the walls of the box. The shock absorbent material has been of various forms such as, for example, loose granules of compressible plastic foam or sheets of plastic which form arrays of air filled bubbles. In other cases, separable blocks of compressible foamed plastic material are used to support the contained article within the box. Inflatable liner inserts have also been used for this purpose.

Boxes for packaging manufactured articles are usually not shipped to the factory in assembled form. Large numbers of assembled boxes would be extremely bulky. Rather, the boxes are initially flat panels of corrugated cardboard or other box material which are marked with fold lines that enable the box to be folded into a box configuration as part of the article packaging operation at the factory. A stack of the flat panels is much easier to transport and store than an equivalent number of assembled boxes.

Prior shock absorbent linings including inflatable liners are added to the box after it has been assembled from the initially flat panel. This additional step is a significant complication of the packaging process which adds to the cost of the process. Prior methods of cushioning packaged articles can also complicate opening the box and removal of the article particularly if there are loose granules of shock absorbent material to be disposed of.

It desirable to reduce the volume of material which is discarded at landfills or other waste disposal sites. Discarded packaging materials form a significant portion of such wastes. Foamed plastic granules or blocks as used for the purposes described above are bulky and remain bulky after being disposed of.

The present invention is directed to overcoming one or more of the problems discussed above.

SUMMARY OF THE INVENTION

In one aspect this invention provides container paneling which is foldable to form a pneumatically padded box. The paneling includes a substantially flat sheet of box material having fold lines demarcated thereon which fold lines define a box bottom region of the sheet and a box top region of the sheet and box side regions of the sheet. An array of inflatable air pouches is secured to a face of the flat sheet with air pouches being situated at each of the box bottom, box top and box side regions of the sheet.

In another aspect of the invention, the air pouches are joined to each other and air passages extend between the pouches enabling simultaneous inflation of the pouches after an article has been placed in the assembled and closed box. An air valve communicates with one of the interconnected air pouches and is accessible through an opening in the box material after assembly and closure of the box.

In another aspect, the invention provides an article container comprising a box having top and bottom and side portions each having an inner wall surface facing the interior of the box. The box includes a plurality of inflatable air pouches with at least one of the air pouches being secured to the inner wall surface of each of the top and bottom and side portions of said box. The air pouches are communicated with each other enabling simultaneous inflation and deflation of the pouches. An air valve communicates with one of the pouches and is positioned to be accessible from outside of the box after closing of the box.

The invention enables a simplified and more economical packaging of articles which are to be cushioned against external forces. Folding of flat paneling into a box configuration also folds an array of inflatable air pouches into a configuration which supports and cushions an article or articles in the box. The inflated pouches accommodate to articles of different sizes and shapes. Separate steps for adding cushioning material or a liner to the assembled box are not needed. The air pouches may be deflated when the box is discarded thereby reducing the volume of the discarded material.

The invention, together with further aspects and advantages thereof, may be further understood by reference to the following description of preferred embodiments and by reference to the accompanying drawings.

BRIEF DESCRIPTION OF THE DRAWINGS

FIG. 2 is a section view of the container paneling of FIG. 1 taken along line 2—2 thereof.

FIG. 3 is a section view of the container paneling of FIG. 1 taken along line 3—3 thereof.

FIGS. 4 to 8 depict successive stages in the forming of the container paneling into a box and packaging of an article therein.

FIG. 9 is a top view of the assembled and closed box depicting the configuration of inflated air pouches therein in the absence of a packaged article in the box.

FIG. 10 is a side view of the assembled and closed box further illustrating the configuration of inflated air pouches therein in the absence of a package article in the box.

DETAILED DESCRIPTION OF THE PREFERRED EMBODIMENTS

Figure 1:
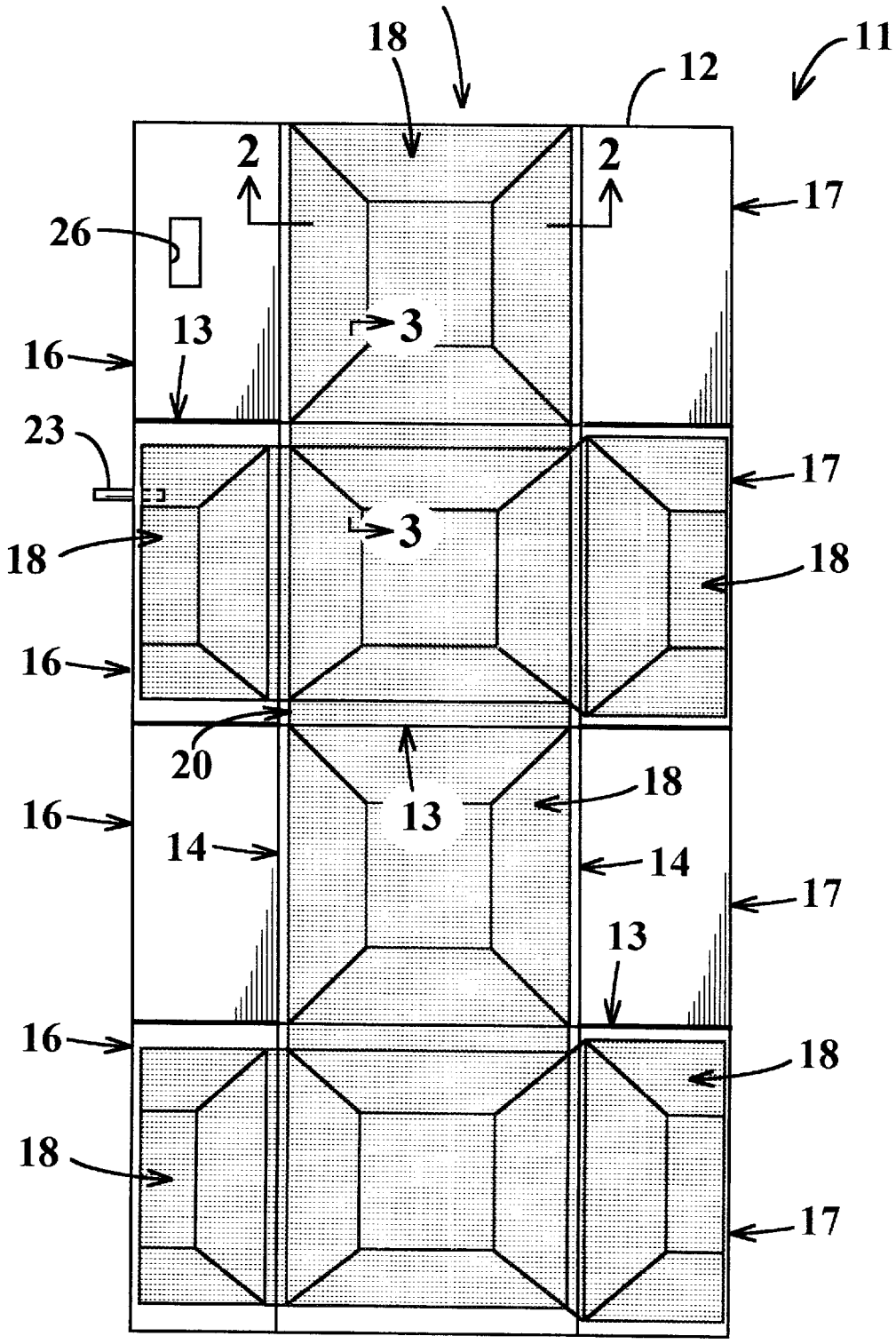
FIG. 1 is a plan view of container paneling in accordance with a first embodiment of the invention.

Referring initially to FIG. 1 of the drawings, container paneling 11 in accordance with the depicted embodiment of the invention includes a flat sheet 12 of box material which will eventually be folded into a rectangular box configuration. The box material may typically be corrugated cardboard although other foldable materials of the types of which boxes are formed may also be used. Three spaced apart transverse fold lines 13, which are parallel to the transverse edges of sheet 12, are marked on the sheet. Two spaced apart longitudinal fold lines 14, which are parallel to the longitudinal edges of sheet 12, are also marked on the sheet.

Referring jointly to FIGS. 1 and 2, the fold lines 12 and 14 are preferably defined by scored grooves indented into the surface of sheet 12. This causes bending of the sheet 12 to be concentrated at the fold lines 12 and 14 during the box assembly operations to be hereinafter described.

Referring again to FIG. 1 in particular, the portions of the transverse fold lines 13 which extend between the longitudinal fold lines 14 and the longitudinal edges of sheet 12 are slits which penetrate through the material of the sheet. This divides the side regions of sheet 12 into independently foldable box top flaps 16 situated along one side of the sheet and independently foldable box bottom flaps 17 situated along the other side of the sheet. Box top flaps 16 jointly define a box top region of the sheet 12 and flaps 17 jointly define a box bottom region of the sheet. Portions of the sheet 12 between longitudinal fold lines 14 constitute a box sides region of the sheet.

The spacing of transverse fold lines 13 from each other and the spacing of longitudinal fold line 14 from each other determine the proportions of the box and can be varied to accommodate to the proportions of the article or articles that will be contained in the box. In this example the transverse fold lines 13 are equidistantly spaced from each other and are spaced from the transverse edges of sheet 12 by the same distance. Longitudinal fold lines 14 are spaced from each other by the same distance and are spaced from the longitudinal edges of sheet 12 by one half of that distance. This spacing of fold lines provides for assembly of a cubical box from this example of the container paneling 11.

Cushioning of articles which will be contained in the box is provided for by an array of inflatable air pouches 18 which are secured to the surface of sheet 12 that will face the inside of the box when the box is assembled. Four such pouches 18 of initially rectangular outline are situated between the longitudinal fold lines 14 with each being between a pair of the transverse fold lines 13 or between a transverse fold line and one of the transverse edges of sheet 12. Additional pouches 18 are secured to two of the top flaps 16 that are separated by a top flap that does not have a pouch thereon and pouches are also present on the corresponding bottom flaps 17. The pouches 28 on top flaps 16 and on bottom flaps 17 are half as large as the pouches between longitudinal fold lines 14 as the flaps themselves are half as large as the region of the sheet 12 that is between the longitudinal fold lines. The pouches 18 on bottom flaps 17 may be slightly larger than the pouches on top flaps 16 as the bottom pouches sustain the weight of articles which will be contained in the box.

Referring jointly to FIGS. 1, 2 and 3, the inflatable air pouches 18 may be separate pouches but are preferably interconnected components of a single array of pouches formed by first and second layers, 19 and 21 respectively, of air impervious flexible plastic sheeting. The edges of the first and second layers 19 and 21 are bonded together by thermal bonding, adhesive or other means. Portions 20 of the layers 19 and 21 which extend across fold lines 13 and 14 enable passage of air between adjacent pouches 18. The first layer 19 of plastic sheeting is secured to the flat sheet 12 of box material by a layer of adhesive 25.

The second layer 21 of plastic sheeting is shaped to be of greater area at each pouch 18 than the portion of the first layer 19 which is at the pouch. This allows the second layer 21 at each pouch 18 to bulge outward from the first layer 19 when the pouch is inflated as will hereinafter be described in further detail. Preferably the second layer 21 of plastic sheeting is shaped to cause the pouches 18 which are between longitudinal fold lines 14 to assume the shape of truncated four sided pyramids when the pouches are inflated. The portions of second layer 21 which are between the longitudinal fold lines 14 and the longitudinal edges of the sheet 12 of box material are preferably shaped to cause the pouches 18 at those locations to assume the shape of one half of such a pyramid upon being inflated. This shaping of the portions of the second layer 21 which are at each pouch 18 causes those portions to exhibit folds 22 when the pouches are uninflated and the second layer is flattened against the first layer 19.

The inflated pouches assume the truncated pyramidal configuration when an article contained in the assembled box has a rectangular shape and essentially surround the article with pneumatic padding. The inflated pouches inherently deform into other configurations which may be needed to surround articles of different shape with padding. In either case the pouches accommodate to articles of different sizes.

The air passages 24 between adjacent pouches 18 which are formed by the plastic sheeting layers 19 and 21 at fold lines 13 and 14 in this embodiment enable simultaneous inflation and deflation of all of the pouches 18 through a single air flow valve 23. Alternately, air pouches which are otherwise isolated from each other can be intercommunicated through bendable plastic tubes which extend across the fold lines.

Valve 23 may, for example, be of the known type which is used on vehicle tires to inflate and deflate the tire. The valve 23 of this example extends outward from an air pouch 18 which is on a top flap 16 and projects outward from the adjacent longitudinal edge of the sheet 12 of box material. An opening 26 in an adjacent top flap 16 is located to enable access to valve 23 after the container paneling 11 has been folded into its box configuration and been sealed closed with adhesive tape as will hereinafter be described.

Figure 5:
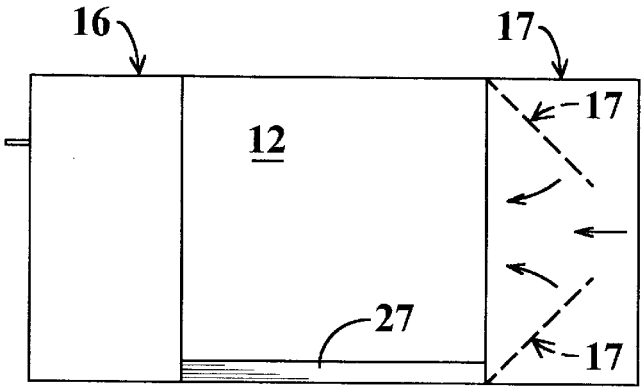
Figure 6:
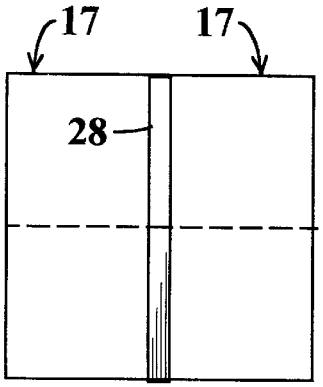

Formation of a pneumatically padded box from the container paneling 11 begins by folding the paneling along transverse fold lines 13 into a rectangular configuration as shown in FIG. 4. A strip 27 of adhesive coated tape, shown in FIG. 5, is then used to join the opposite transverse edges of the container paneling 11 together. The bottom flaps 17 which have air pouches 18 thereon are then folded into a right angled relationship with the side regions of the box, as shown in FIG. 5, to form the inner portion of the bottom of the box. The other two bottom flaps 17 are then folded to lay against the first two and are joined together by another strip 28 of adhesive coated tape as shown in FIG. 6.

Figure 7:
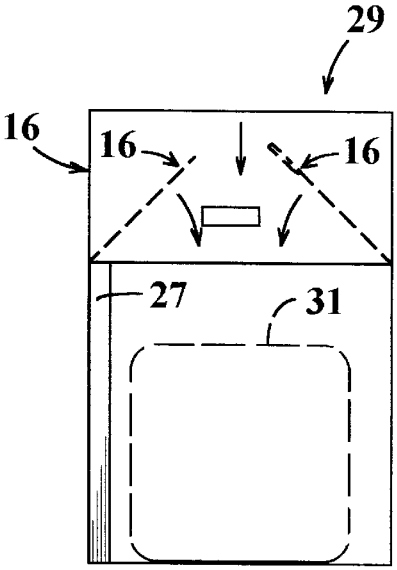
Figure 8:
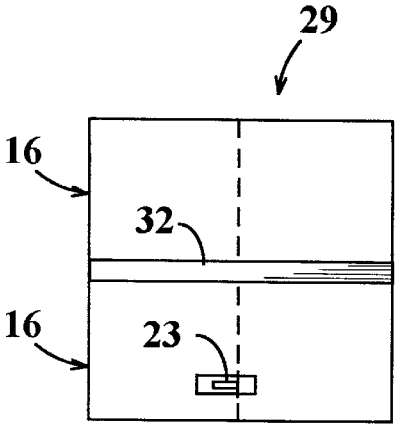

Referring to FIG. 7, the box 29 may then be turned to an upright position and the article 31 or articles which are to be contained are entered into the box. The two top flaps 16 which have air pouches 18 thereon are then folded down into a right angled relationship with the sides of the box 29 after which the other two top flaps are folded to lay against the first two top flaps. Another strip 32 of adhesive coated tape, shown in FIG. 8, is then used to join the abutted edges of the outermost of the top flaps 16.

Referring jointly to FIGS. 9 and 10, pouches 18 are then inflated and pressurized by directing compressed air into the pouches through valve 23. The pouches 18 than expand to bear against and cushion the contents of the box 29. For purposes of illustration, FIGS. 9 and 10 show the inflated pouches 18 in the previously described truncated pyramidal and half pyramidal shapes which are assumed if the box 29 is empty. In practice, the inflated pouches 18 deform as necessary to accommodate to the shape of the article or articles which are contained in the box 29.

Figure 11:
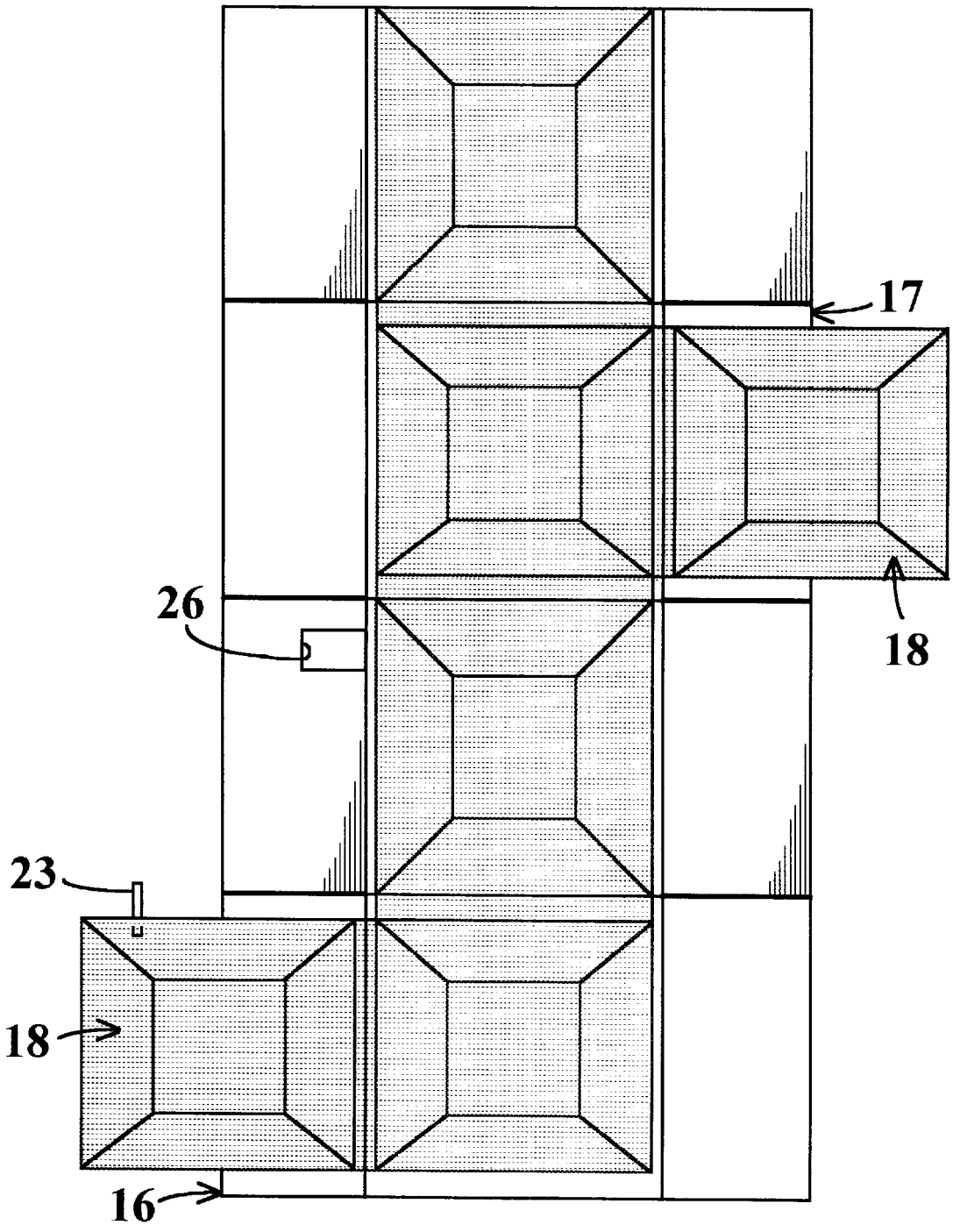
FIG. 11 is a plan view of container paneling corresponding generally to FIG. 1 while illustrating a modification of the container paneling.

Referring to FIG. 11, the configuration of the array of inflatable air pouches 18 may vary from that previously described. In this embodiment the bottom of the box is cushioned by a single pouch 18 secured to a single one of the bottom flaps 17 and the top of the box is cushioned by a single pouch 18 secured to a single one of the top flaps 16.

The pouches 18 on the bottom flap 17 and top flap 16 in this case are of the same size as the other pouches in the box and expand into the previously described truncated four sided pyramidal shape rather than into the half pyramids as in the previously described embodiment. Air valve 23 in this case extends from the top panel pouch 28 in a direction which is parallel to the longitudinal fold lines 14. The embodiment of FIG. 11 may otherwise be similar to the previously described embodiment.

Thus while the invention has been described with reference to certain specific embodiments for purposes of example, many variations and modifications are possible and it is not intended to limit the invention except as defined in the following claims.

What is claimed is:

1. Container paneling which is foldable to form a pneumatically padded box comprising:

a substantially flat sheet of box material having fold lines demarcated thereon which fold lines define a box bottom region of the sheet and a box top region of the sheet and box side regions of the sheet, said sheet of box material having an inner face which bounds the interior of the box when the sheet of box material is folded into a box configuration, and an array of inflatable air pouches secured to said inner face of said flat sheet of box material wherein air pouches are situated at each of said box bottom and box top and box side regions of said sheet, wherein said flat sheet of box material is rectangular and has longitudinally extending opposite edges and transversely extending opposite edges, wherein said fold lines include a pair of spaced apart longitudinal fold lines which extend in parallel relationship with said longitudinal edges and three spaced apart transverse fold lines which extend in parallel relationship with said transverse edges thereby defining four of said box side regions which are situated between said longitudinal fold lines and defining four box bottom flaps situated between one of said opposite edges and a one of said longitudinal fold lines and defining four box top flaps situated between the other of said opposite edges and the other of said longitudinal fold lines, one of said air pouches being secured to said flat sheet of box material at each of said box side regions and at least one of said box bottom flaps and at least one of said box top flaps.

2. The container paneling of claim 1 wherein portions of said transverse fold lines which extend between said longitudinal fold lines and said longitudinally extending opposite edges are defined by slits in said flat sheet of box material thereby enabling folding of box bottom flaps into orientations which are at right angles to each other and folding of box top flaps into orientations which are at right angles to each other.

3. The container paneling of claim 2 wherein an air valve is secured to one of said box top flaps and communicates with one of said air pouches thereat, and wherein another of said box top flaps which overlays said one of said box top flaps when said paneling is formed into said box has an opening therein enabling access to said valve.

4. The container paneling of claim 2 wherein a pair of said air pouches are secured to a spaced apart pair of said box bottom flaps and another pair of said air pouches are secured to a spaced apart pair of said box top flaps.

5. The container paneling of claim 2 wherein an air pouch secured to one of said box top flaps is larger than the box top flap and is proportioned to extend under an adjacent one of said box top flaps when the container paneling is folded into the box configuration.

6. The container paneling of claim 2 wherein an air pouch secured to one of said box bottom flaps is larger than the box bottom flap and is proportioned to extend under an adjacent one of said box bottom flaps when the container paneling is folded into the box configuration.

* * * * *